United States Patent [19]

Hughes

[11] 4,132,018

[45] Jan. 2, 1979

[54] DECORATIVE PLAGUE AND MULTIPLE-PURPOSE HANGER AND STAND THEREFOR

[76] Inventor: Terence P. Hughes, 3940 Joppa Ave. South, Minneapolis, Minn. 55416

[21] Appl. No.: 793,526

[22] Filed: May 4, 1977

[51] Int. Cl.[2] ..... G09F 7/18

[52] U.S. Cl. ..... 40/152.1; 40/594; 40/610; 248/126

[58] Field of Search ..... 40/152.1, 152, 156, 40/125 H, 128, 1.5, 125 A; 248/126, 12, 205 A, 206 A

[56] References Cited

U.S. PATENT DOCUMENTS

| | | | |
|---|---|---|---|
| 715,532 | 12/1902 | Anderson | 40/152.1 X |
| 2,659,169 | 11/1953 | Brennan | 40/1.5 |
| 2,977,082 | 3/1961 | Harris | 248/206 A |
| 3,165,283 | 1/1965 | Borisof | 248/205 A |
| 3,757,443 | 9/1973 | Miller et al. | 40/125 H |

*Primary Examiner*—Louis G. Mancene
*Assistant Examiner*—G. Lee Skillington
*Attorney, Agent, or Firm*—Schroeder, Siegfried, Ryan, Vidas & Steffey

[57] ABSTRACT

A decorative plaque having a mounting hole through its face is supported on horizontal surfaces by a disc having a trough cut across its top surface to receive the lower edge of the plaque and to support the plaque in a vertical position. The plaque may alternatively be mounted on a vertical surface by affixing the back surface of the disc to a vertical wall using double-backed tape, then aligning the mounting hole in the plaque with the disc and pushing the plaque over the disc.

2 Claims, 6 Drawing Figures

DECORATIVE PLAGUE AND MULTIPLE-PURPOSE HANGER AND STAND THEREFOR

This invention relates to the field of decorative plaques and particularly to a decorative wall plaque with a multiple-purpose hanger and base stand for mounting the plaque either vertically or horizontally by means of the same device.

There are a number of methods and devices for supporting small plaques, picture frames, or similar objects in a desired position on a wall. There are also numerous stands for supporting plaques or pictures on horizontal surfaces. Such prior art mounting and supporting hardware is generally utilizable for mounting or supporting an item on a horizontal surface or on a vertical surface but is not usable to perform both functions.

Although there is apparatus presently available which may support a plaque or picture on a horizontal surface and which may also be attachable to a wall to support such a plaque or picture on a vertical surface, such structures are relatively bulky and their appearance generally detracts from the visual impact of the item which they support, particularly where the object to be mounted is substantially transparent and has its aesthetic appeal based on its uncluttered appearance. In many cases, prior art multiple-purpose mounting devices do not permit the user to mount the plaque in close proximity with the wall surface and to vertically support the plaque or picture on a horizontal surface.

The present invention eliminates the disadvantages which have been found in the prior art. The present invention defines its embodiments in a dual-purpose mounting disc which supports the plaque or picture frame at its lower edge in a trough cut into the disc so that the frame can be supported on a horizontal surface. The same disc can also be directly affixed to a vertical surface or wall to act as a hanger when the mounting hole in the plaque is fitted over the disc.

It is, therefore, a general object of the present invention to provide an improved combination of a plaque and mounting structure therefor.

It is a more specific object of this invention to provide a plaque and a mounting means which is utilizable to mount the plaque on either a vertical or on a horizontal surface.

It is still another object of this invention to provide a plaque and mounting means therefor which may be packaged in a package having a thickness which does not exceed the thickness of the plaque.

These and other objects and advantages of the invention will more fully appear from the following descriptions, made in connection with the accompanying drawings, wherein like reference characters refer to the same or similar parts throughout the several views, and in which.

Figure 1:
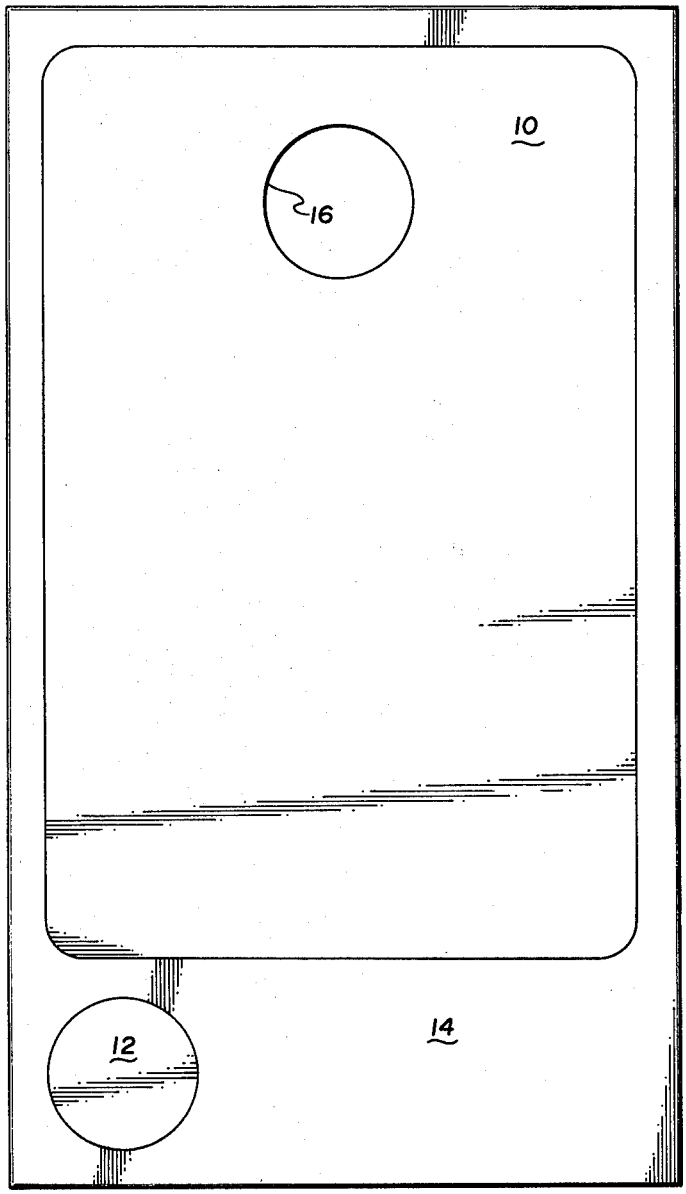
FIG. 1 is a front view of the plaque and mounting disc in their display packaging.
Figure 2:
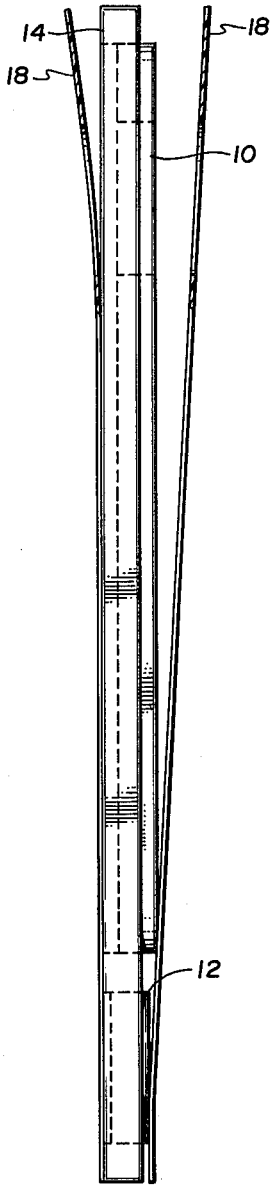
FIG. 2 is a side view of the assembly of the plaque and mounting disc in the display packaging showing a portion of the protective packaging being pulled away.

In FIG. 1, a plaque or picture frame 10 and a mounting disc 12 are inserted into die cut openings in a plaque holder 14. In the preferred embodiment, plaque 10 and disc 12 are made from transparent or translucent plastic such as Rohm and Haas clear and translucent Plexiglasses. The plaque holder 14, which is used to support plaque 10 and disc 12 in the display packaging, can be formed from polystyrene foam or conventional corrugated materials. The thickness of plaque holder 14 is substantially equal to the thickness of plaque 10 and disc 12.

Plaque 10 has a hole 16 located on a vertical center line of the plaque and is located near the upper edge of the plaque. The diameter of hole 16 is slightly greater than the diameter of disc 12.

Disc 12 and plaque 10 are sealed into holder 14 using plastic film 18. After film 18 is applied and sealed, an aperture at hole 16 is cut through film 18 so that the entire package can be supported on a display rack or the like by utilizing the hole for its support.

In the preferred embodiment, plaque 10 carries a printed message hot-stamped on either or both surfaces of the plastic. The transparent or translucent plastic allows for light transmission from the rear surface, for illuminating the printed message. The entire face of the plaque is visible through both sides of the packaging. Plaque 10 and disc 12 can readily be removed from the packaging by peeling film 18 from plaque holder 14.

Figure 3:
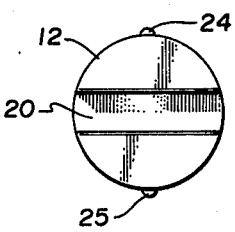
FIG. 3 is a back view of the mounting disc.
Figure 4:
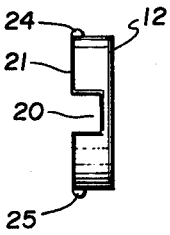
FIG. 4 is a side view of the mounting disc.

FIGS. 3 and 4 show the mounting disc 12 in further detail. A slot or trough 20 is cut deeply into one face 21 of disc 12. Slot 20 is cut completely across the face of the disc and has a width slightly exceeding the thickness of plaque 10. Disc 12 is also provided with projecting dimples 24 and 25, which are positioned near face 21 of the disc 12 into which slot 20 has been cut.

Figure 5:
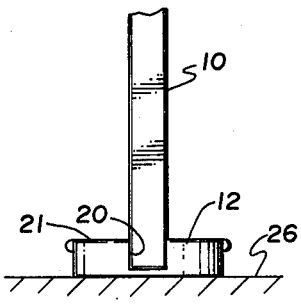
FIG. 5 is a side view of the mounting disc supporting a plaque on a horizontal surface.

FIG. 5 shows disc 12 in position on a horizontal surface 26 with plaque 10 inserted in slot 20 to support plaque 10 in a vertical position.

Figure 6:
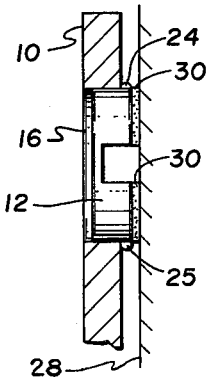
FIG. 6 is a side view of the mounting disc supporting a plaque on a vertical surface.

FIG. 6 shows plaque 10 mounted on disc 12 with disc 12 attached to a vertical wall 28 utilizing double-backed tape 30. The projecting dimples 24 and 25 are used in the preferred embodiment to provide a slight offset between plaque 10 and wall 28. The double-backed tape 30 can be attached to disc 12 prior to being packaged in holder 14. In this case, a protective sheet is applied to the exposed portion of double-backed tape 30 to prevent its inadvertent adhesion to an undesired surface. This protective sheet is then removed prior to the affixing of disc 12 to a vertical wall used as a hanger for plaque 10. If it is desired to use disc 12 as a mounting supporting for plaque 10 on a horizontal surface, double-backed tape 30 and its protective strip can both be removed from surface 21 of disc 12 by peeling them off.

It will, of course, be understood that various changes may be made in the form, details, arrangement, and proportions of the parts without departing from the scope of the invention which consists of the matter shown and described herein and set forth in the appended claims.

What is claimed is:

1. In combination with a decorative frame having an indentation of substantial area penetrating into at least its rear face, dual-purpose mounting means comprising:

a disc having a thickness substantially corresponding to the depth of said indentation into said rear face of said plaque and having a cross-sectional area cooperatively related to the area of said indentation to permit insertion of said disc into said indentation to permit said plaque to be suspended from said disc when said disc is affixed to a wall and wherein the circumference of said disc on a face is provided with at least one projection which, when said face of said disc is affixed to a vertical wall, assures that said frame, when suspended from said disc, is not in contact with said wall in the vicinity of said indentation; and wherein said face of said disc is provided with means for affixing said disc to said wall; and said disc having one surface interrupted by a transverse slot adapted to receive the lower edge of said frame to support said frame when said disc is placed on a horizontal surface.

2. Apparatus as claimed in claim 1 wherein said face of said disc is provided with double-backed tape to attach said disc to said wall.

* * * * *

UNITED STATES PATENT AND TRADEMARK OFFICE

CERTIFICATE OF CORRECTION

PATENT NO. : 4,132,018

DATED : January 2, 1979

INVENTOR(S) : Terence P. Hughes

It is certified that error appears in the above-identified patent and that said Letters Patent are hereby corrected as shown below:

Title Page, Column 1, Line 1, delete "PLAGUE", and insert --PLAQUE--.

Column 1, Line 1, delete "PLAGUE", and insert --PLAQUE--.

Column 1, Line 34, delete "embodiments", and insert --embodiment--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*